US011613389B2

(12) United States Patent
Lebel et al.

(10) Patent No.: US 11,613,389 B2
(45) Date of Patent: Mar. 28, 2023

(54) BULK FEEDING APPARATUS AND FILLING MACHINE AND METHOD

(71) Applicant: Blue Sky Ventures (Ontario) Inc., Toronto (CA)

(72) Inventors: Alexandre Lebel, Laval (CA); Simon Lajoie, Montréal (CA)

(73) Assignee: Blue Sky Ventures (Ontario) Inc., Toronto (CA)

( * ) Notice: Subject to any disclaimer, the term of this patent is extended or adjusted under 35 U.S.C. 154(b) by 11 days.

(21) Appl. No.: 17/194,933

(22) Filed: Mar. 8, 2021

(65) Prior Publication Data

US 2021/0284366 A1 Sep. 16, 2021

Related U.S. Application Data

(60) Provisional application No. 62/987,557, filed on Mar. 10, 2020.

(51) Int. Cl.

| | |
|---|---|
| ***B65B 5/10*** | (2006.01) |
| ***B65B 57/20*** | (2006.01) |
| ***B65B 35/40*** | (2006.01) |

(52) U.S. Cl.

CPC ..... *B65B 5/101* (2013.01); *B65B 5/106* (2013.01); *B65B 35/40* (2013.01); *B65B 57/20* (2013.01)

(58) Field of Classification Search

CPC ..... B65B 5/101; B65B 5/106; B65B 5/103; B65B 57/14; B65B 57/20; B65B 35/40; B65B 35/06; B65B 35/14

See application file for complete search history.

(56) References Cited

U.S. PATENT DOCUMENTS

| | | | | |
|---|---|---|---|---|
| 3,925,960 | A * | 12/1975 | Saari | B65B 37/005 53/167 |
| 6,311,743 | B1 | 11/2001 | Baroncini | |
| 7,389,632 | B2 | 6/2008 | Seiffert | |
| 7,451,581 | B2 | 11/2008 | Kim | |
| 7,451,676 | B2 | 11/2008 | Thurston | |
| 8,141,330 | B2 | 3/2012 | Henkel | |
| 8,579,153 | B2 | 11/2013 | Yuyama | |
| 8,601,776 | B2 | 12/2013 | Henkel | |
| 8,944,280 | B2 | 2/2015 | Yuyama | |
| 9,493,290 | B2 | 11/2016 | Yuyama | |
| 9,663,260 | B2 | 5/2017 | Morita | |
| 9,790,017 | B2 | 10/2017 | Yuyama | |
| 10,370,135 | B2 | 8/2019 | Lapointe | |
| 2013/0247521 | A1* | 9/2013 | May | B65B 65/02 53/235 |

(Continued)

FOREIGN PATENT DOCUMENTS

| | | | | |
|---|---|---|---|---|
| CA | 2714014 | | 5/2010 | |
| CN | 106628351 | A * | 5/2017 | B65B 35/20 |

(Continued)

*Primary Examiner* — Thomas M Wittenschlaeger
(74) *Attorney, Agent, or Firm* — Thompson Hine LLP

(57) ABSTRACT

A filling machine for filling containers with items includes an item conveyor, and a bulk feeder for feeding items onto the item conveyor. The bulk feeder includes a hopper and a feed assembly, where the feed assembly includes an item collecting compartment for collecting items from the hopper. A pusher is movable through the collecting compartment to push items in the collecting compartment onto the item conveyor.

22 Claims, 18 Drawing Sheets

(56) References Cited

U.S. PATENT DOCUMENTS

2018/0194552 A1 7/2018 Lucas

FOREIGN PATENT DOCUMENTS

| | | | | | |
|---|---|---|---|---|---|
| EP | 1864908 | | 12/2007 | | |
| EP | 2168874 | | 3/2010 | | |
| EP | 3359451 | | 8/2018 | | |
| JP | H0674433 A | * | 3/1994 | ..... | F23G 5/32 |

* cited by examiner

BULK FEEDING APPARATUS AND FILLING MACHINE AND METHOD

TECHNICAL FIELD

This application relates generally to item feed systems and, more specifically, to a bulk feeding apparatus of a type that may be used in filling machines in which items are conveyed, checked, counted and grouped for purposes of filling containers or packages with a set number of the items.

BACKGROUND

In the packaging of bulk quantity items, such as pharmaceutical tablets or capsules, the items must be counted and grouped in order to fill containers, packages or other receptacles with a desired number of the items. Large quantities of the items are handled by filling machines that are used for this purpose, and the items are fed to the machine from a bulk feeding apparatus.

Accordingly, an improved bulk feeding apparatus that delivers consistent item quantity onto an initial conveyor of the filling machine.

SUMMARY

In one aspect, a filling machine for filling containers with items includes an item conveyor, and a bulk feeder for feeding items onto the item conveyor. The bulk feeder includes a hopper for holding a plurality of the items, the hopper having an outlet opening, and a feed assembly positioned adjacent the outlet opening, the feed assembly having an inlet and an outlet, the inlet positioned to receive items from the outlet opening of the hopper, the outlet positioned so that items can be fed on to the item conveyor. The feed assembly includes an item collecting compartment for collecting items that pass through the inlet from the hopper, and a pusher movable from a first position to a second position. In the first position, the pusher is retracted from the collecting compartment. As the pusher moves from the first position to the second position, the pusher moves through the collecting compartment to push items in the collecting compartment to the outlet and onto the item conveyor.

In another aspect, a filling machine for filling containers with items includes a housing at least in part defining an internal space, the housing having an opening, with a rotatable disc is sealingly mounted in the opening. An item conveyor is located external of the internal space. A pusher is external of the internal space and is movable from a first position to a second position so as to push items onto the item conveyor. A drive is located within the internal space, the drive operatively connected for rotating the rotatable disc. The rotatable disc is coupled to move the pusher linearly as the rotatable disc rotates.

In yet another aspect, a filling machine for filling containers with items includes housing at least in part defining an internal space, the housing having an opening, an item conveyor external of the internal space, a pusher external of the internal space and movable from a first position to a second position so as to push items onto the item conveyor. A motor is operatively connected for moving the pusher. A controller is operatively connected to control the motor, the controller configured to rotate the motor such that the pusher is repeatedly moved back and forth between the first position and the second position. The controller is configured to rotate the motor such that the pusher is moved from the first position to the second position in a first travel time, and the pusher is moved from the second position to the first position in a second travel time, wherein the second travel time is shorter than the first travel time.

In still another aspect, a filling machine for filling containers with a specified number of items is provided and includes an item conveyor having an infeed end and a discharge end, the discharge end located such that items traveling along the conveyor are delivered to multiple paths for delivery into containers. A bulk feeder feeds items onto the infeed end of the item conveyor. The bulk feeder includes a hopper for holding a plurality of the items, the hopper having an upper inlet opening and a lower outlet opening, and a feed assembly positioned adjacent the lower outlet opening. The feed assembly includes an inlet and an outlet, the inlet positioned to receive items from the outlet opening of the hopper, the outlet positioned so that items can be fed on to the infeed end of the item conveyor. The feed assembly includes an item collecting compartment below the inlet for collecting items from the hopper and a pusher movable from a first position to a second position. In the first position, the pusher is retracted from the collecting compartment. As the pusher moves from the first position to the second position the pusher moves through the collecting compartment to push items in the collecting compartment to the feed assembly outlet and onto the infeed end of the item conveyor.

The details of one or more embodiments are set forth in the accompanying drawings and the description below. Other features, items, and advantages will be apparent from the description and drawings, and from the claims.

DETAILED DESCRIPTION

Figure 1:
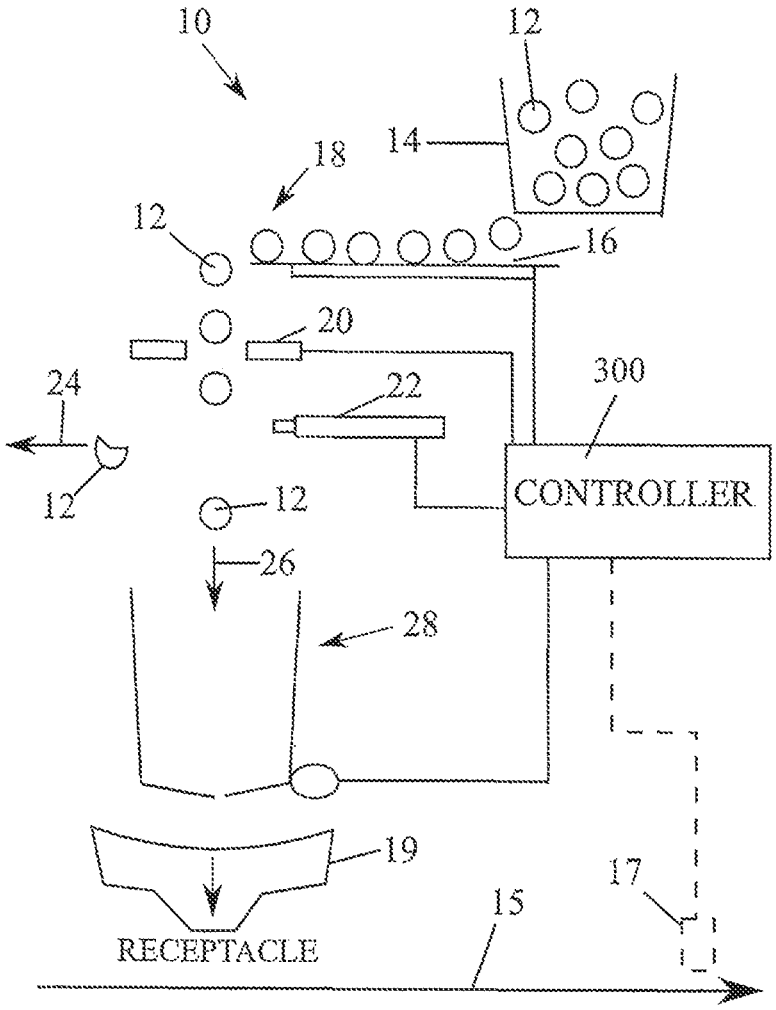
FIG. 1 is schematic depiction of a filling machine.
Figure 2:
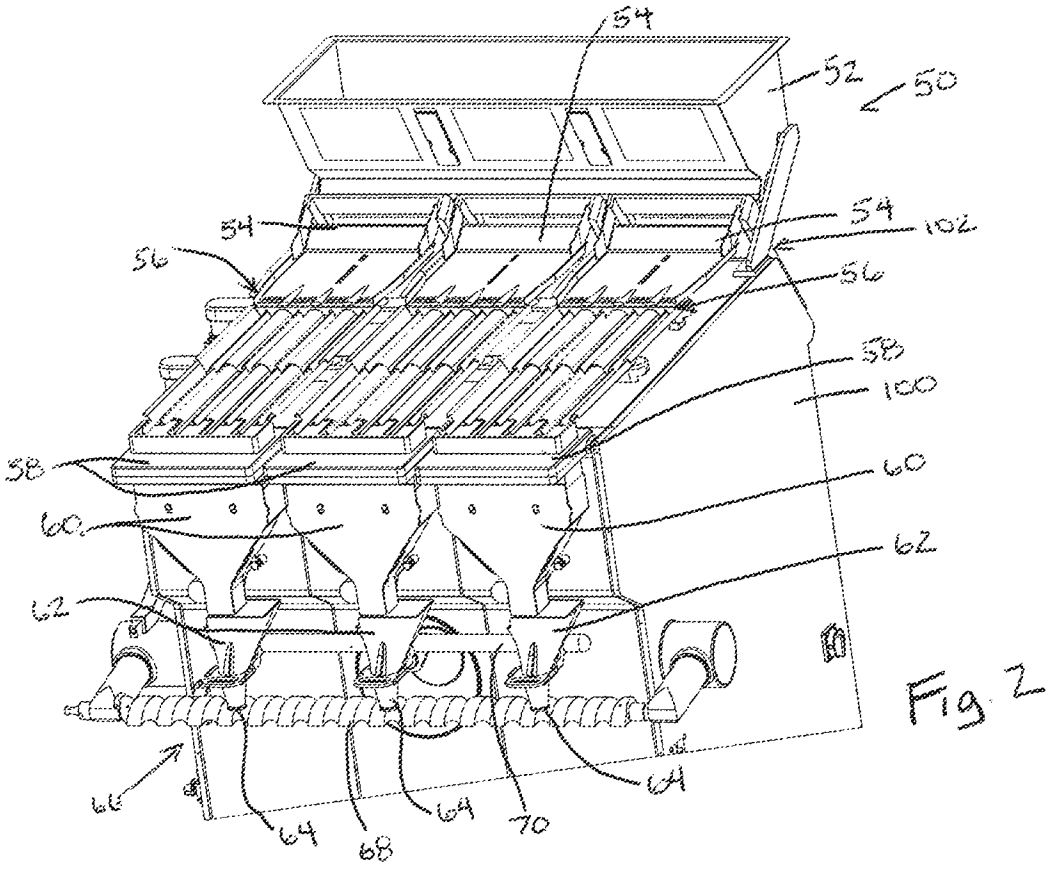
FIG. 2 is a perspective view of an exemplary filling machine.
Figure 3:
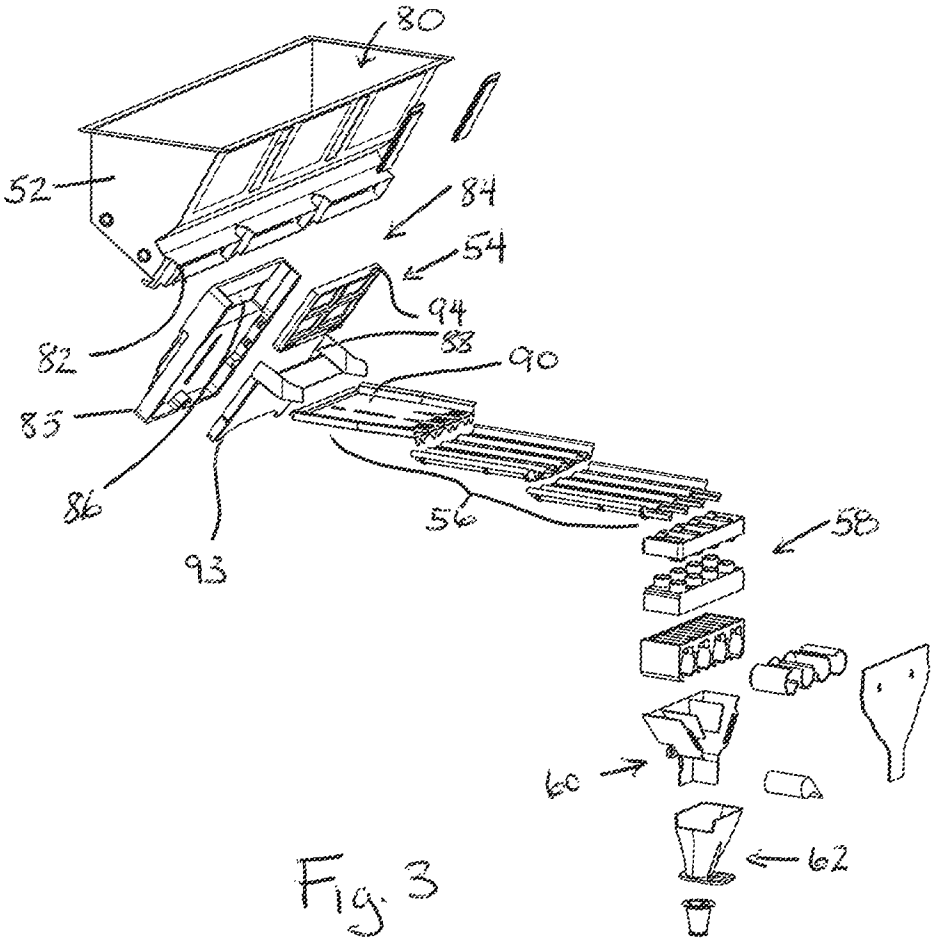
FIG. 3 is a partial exploded view of portions of the filling machine.
Figure 4:
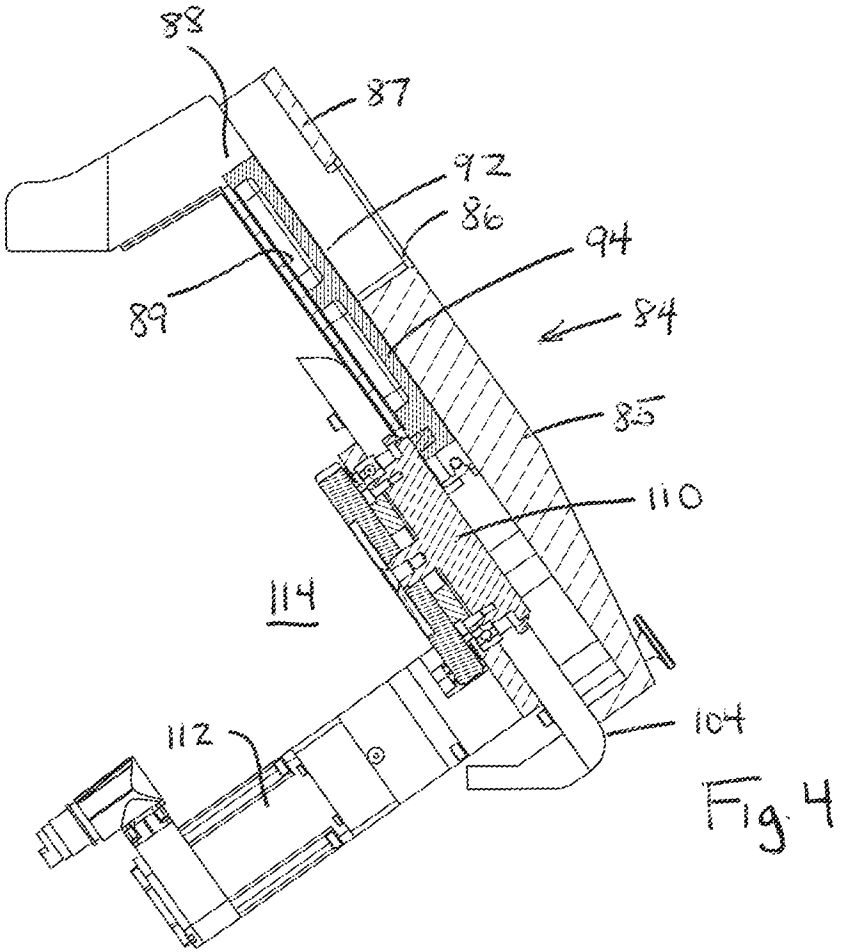
FIG. 4 is side view of a feed assembly mounted on part of the machine housing.
Figure 5:
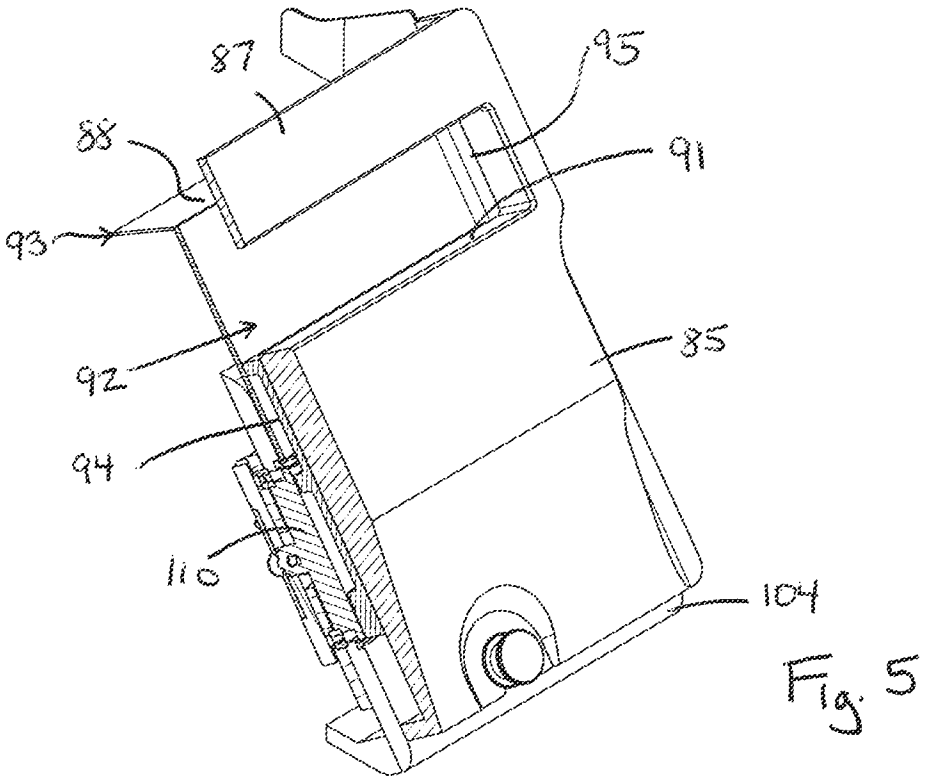
FIGS. 5 and 6 are cross-sections of the feed assembly.

FIG. 1 shows a schematic depiction of a filling device 10 for conveying, counting and analyzing items 12 and feeding the items 12 to a container, package or other receptacle. By way of example, the items may be solid dose tablets, gelcaps or capsules (e.g., of the pharmaceutical variety) and the filling device may be either intermittent or continuous type. The device 10 includes a bulk feeder 14 that deposits the items 12 to a conveyor 16, which aligns, singulates and spaces the items as they are moved to a drop point 18. The conveyor 16 may, for example, be a vibratory conveyor mechanism, as described in more detail below. As the items 12 fall along an item fall path (e.g., under gravity) they pass a sensor system 20, which counts the items as they pass so that an accurate and controlled fill count can be achieved. The sensor system 20 also analyzes the items for defects. In some cases, a reject mechanism 22 may be provided to move defective items to a reject path 24. For example, in the case of solid dose tablets, chipped tablets such as tablet 12' can be rejected. The reject mechanism could, for example, be a pressurized air unit the delivers a burst of pressurized air to move a defective item out of the item fall path and into the reject path 24. The reject mechanism could alternatively be a flap mechanism selectively movable into the item fall path to divert the item out of the item fall path by contact with the flap mechanism. In other implementations, item reject could occur further downstream in a system (e.g., by using a downstream reject mechanism 17 to move a receptacle containing a defective tablet out of the flow of a receptacle conveyance path 15 after the defective tablet is filled into the receptacle). Items 12 that are not rejected follow the fill path 26. A gate system 28 along the fill path 26 may be controlled as desired to achieve delivery of an appropriate item count to a drop chute 19 that feeds receptacles. In a typical filling device, the conveyor 16 may align the items 12 into multiple feed paths that feed the items to multiple drop points, each with a respective sensor system 20, reject mechanism 22 and gating system 28. A controller 300 may be configured to control the various system components, including a pusher or pushers, as explained in more detail below.

Referring now to FIGS. 2-6, one embodiment of a filling machine 50 is shown, which includes a single bulk item hopper 52 with three outfeed sections 54 that feed to three respective vibratory conveyors 56. Each conveyor conveys items to a respective item sense/count section 58 and gating section 60. Each gating section includes an outlet that feeds into a respective drop chute 62 with a lower outlet opening 64. The drop chute outlet openings 64 are positioned above a conveyor 66 that moves containers along a conveyance path beneath the drop chute openings, so that items can be dropped into containers moving along the conveyance path. Here, a belt conveyor transports containers, and a rotating feed screw 68 spaces apart the containers to provide a predetermined or desired pitch. Other conveyor types are possible.

Each outfeed section 54 is configured to repeatedly deliver a consistent quantity of items to the upper section of its vibratory conveyor. In this regard, the hopper 52 includes an upper inlet opening 80 and a lower outlet opening or openings 82. Each outfeed section 54 includes a feed assembly 84 positioned adjacent the lower outlet opening of the hopper. The feed assembly has a cover 85, a pusher 94 and a guide assembly 93. An inlet 86 is provided in the cover. The inlet 86 is positioned to receive items from the outlet opening of the hopper 52, and an outlet 88 is formed at the end of the guide assembly 93, with the outlet positioned so that items can be fed on to the infeed end 90 of the item conveyor 56. The feed assembly 84 includes an item collecting compartment 92 adjacent the inlet 86 for collecting items from the hopper that have moved down through the inlet 86. A fixed, laterally extending segment 87 of the cover 85 is provided to help define, in combination with the upward angle of the compartment floor 89, a chicane in the path of items. In particular, items from the hopper enter the compartment 92 via the opening 86 and gravity forces the items toward the lower end of the compartment (bottom right in FIG. 4). The items, without some applied motive force, cannot move upward to the outlet end 88.

Figure 6:
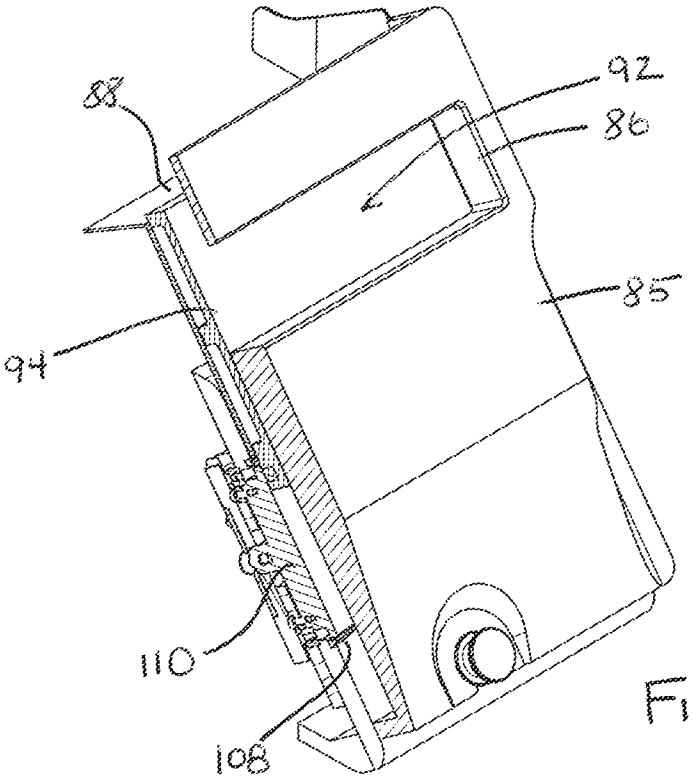
Figure 7A:
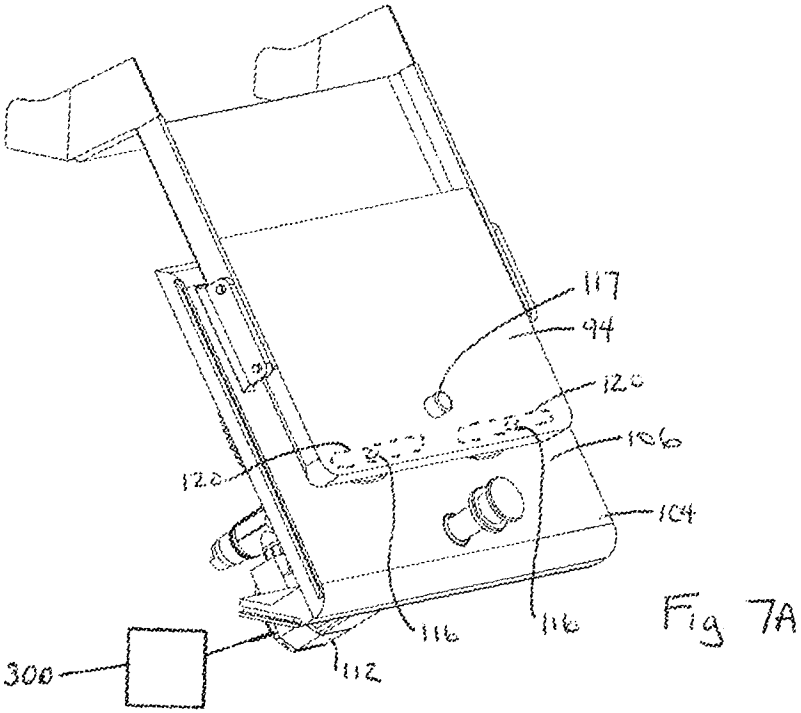
FIGS. 7A and 8A show the feed assembly operation to move the pusher, with cover not shown.
Figure 7B:
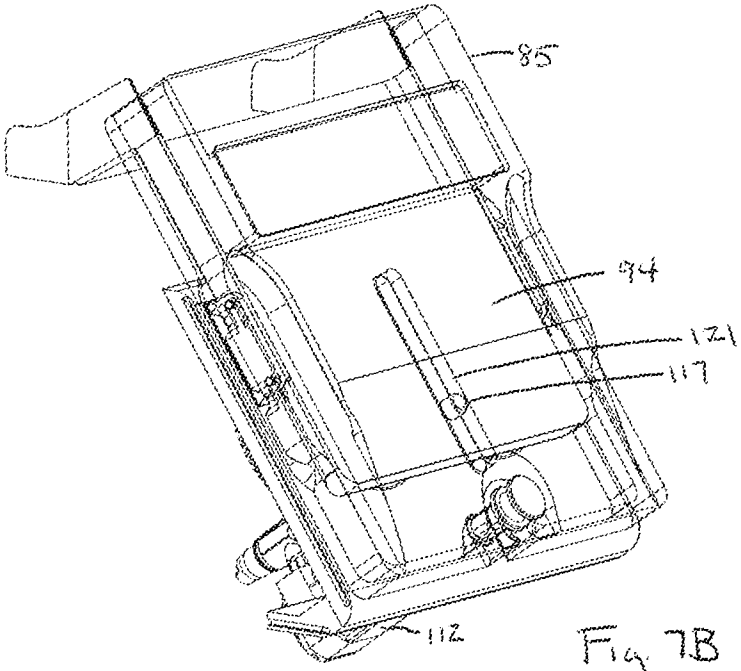
FIGS. 7B and 8B show the feed assembly operation to move the pusher, with the cover depicted transparent.
Figure 8A:
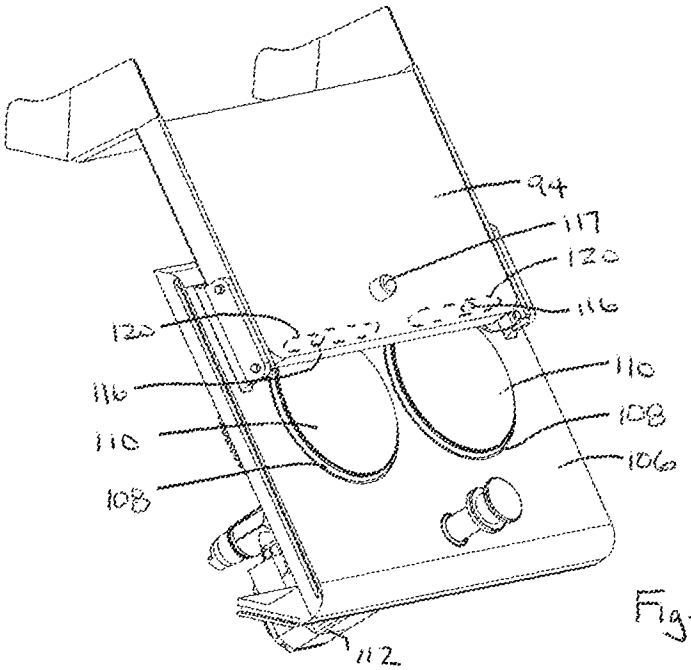
Figure 8B:
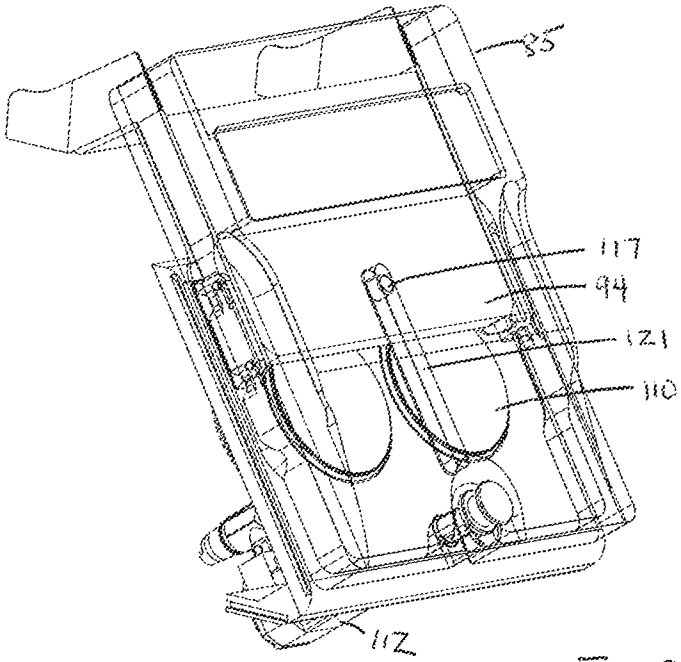

A pusher 94 is movable back and forth between a first position (FIG. 5) and a second position (FIG. 6). In the first position, the pusher 94 is retracted from the collecting compartment 92. As the pusher 94 moves from the first position to the second position, the push end of the pusher 94 moves through the collecting compartment 92 to push items in the collecting compartment to the feed assembly outlet 88 and onto the infeed end 90 of the item conveyor 56. The pusher passes under a rear/lower wall 91 of the cover in the compartment 92. The cover 85, in combination with the guide assembly 93, also forms side sections 95 to help define the compartment 92.

The drive assembly for the pusher is particularly noteworthy. In this regard, the filling machine 50 includes a housing 100 at least in part defining an internal space. The housing includes a rear section 102 along which each feed assembly 84 is located. Part of the rear section 102 of the housing is shown at 104 in FIGS. 5 and 6. The pusher 94, here generally in a plate configuration, is movable along an exterior surface portion of the housing. The exterior surface portion of the housing 104 includes a stationary housing segment 106 having openings 108, and rotatable discs 110 sealingly mounted in the openings. Each rotatable disc 110 is coupled to move the pusher 94 linearly as the rotatable disc 110 rotates.

The drive assembly includes a rotatable motor 112 positioned within the internal space 114 of the housing. The rotatable motor 112 is linked to effect rotation of the rotatable discs 110. Here, each rotatable disc includes a projecting drive link 116 (e.g., a pin) offset from a central rotation axis 118 of the rotatable disc. The pusher 94 includes a lower side or housing facing side with drive slots 120 facing the rotatable disc and into which the drive link 116 projects, such that an orbital movement of the drive link about the central axis 118 causes the drive link 116 to engage a side of the drive slot 120 to effect linear movement of the pusher. In this arrangement, the drive links 116 act as cam pins and the slots 120 act as cam followers. The pusher includes an upper side with a guide pin 117 that slides along a guide slot 121 on the lower or inward side of the cover 85.

The rotatable motor 112 can effect rotation of the discs 110 in either direction. Here, the motor 112 includes an output shaft 130 coupled (e.g., directly or by way of an intermediate transmission) to rotate a drive gear 132. The drive gear 132 is geared to drive a driven gear 134 that is coupled to rotate one of the rotatable discs 110, and the driven gear 134 is geared to drive another driven gear 136 that is coupled to rotate the other rotatable disc 110.

A controller 300 is operatively connected to control the motor 112. The controller 300 is configured to rotate the motor 112 such that the drive gear is in turn rotated such that the pusher 94 is repeatedly moved back and forth between the first position and the second position. In one implementation, the controller 200 is configured to rotate the motor 112 so as to rotate the drive gear 132 such that the pusher 94 is moved at a constant speed when moving from the first position to the second position, in order to feed items onto the conveyor 56 in a uniform manner. The controller may also be configured to rotate the motor 112 so as to rotate the drive gear 132 such that the pusher 94 is moved from the first position to the second position in a first travel time, and the pusher 94 is moved from the second position back to the first position in a second travel time, wherein the second travel time is shorter than the first travel time. In this manner, the speed of repetitive feed operations can be increased overall, while still maintaining an appropriate pusher speed suitable for the feed of the items onto the conveyor.

Figure 9:
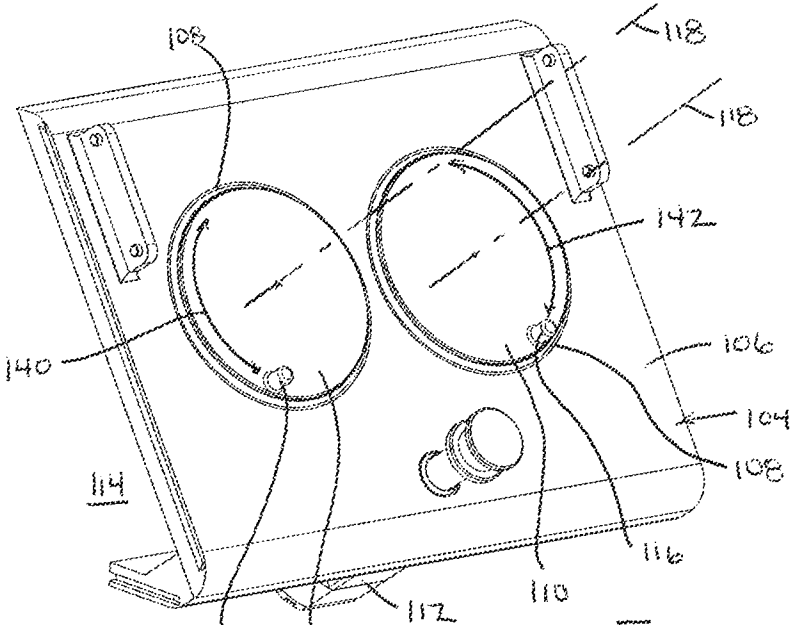
FIGS. 9-11 show exemplary disc rotation to move the pusher.
Figure 10:
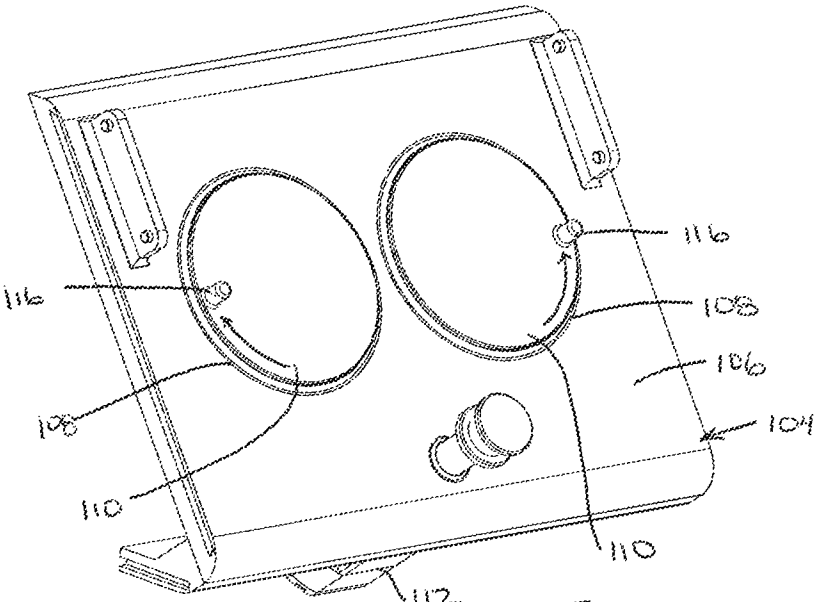
Figure 11:
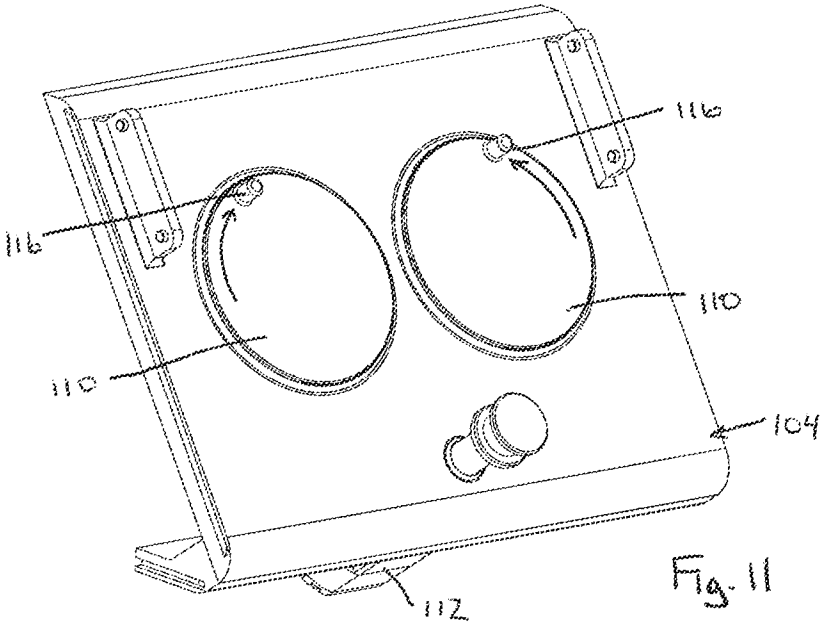
Figure 12A:
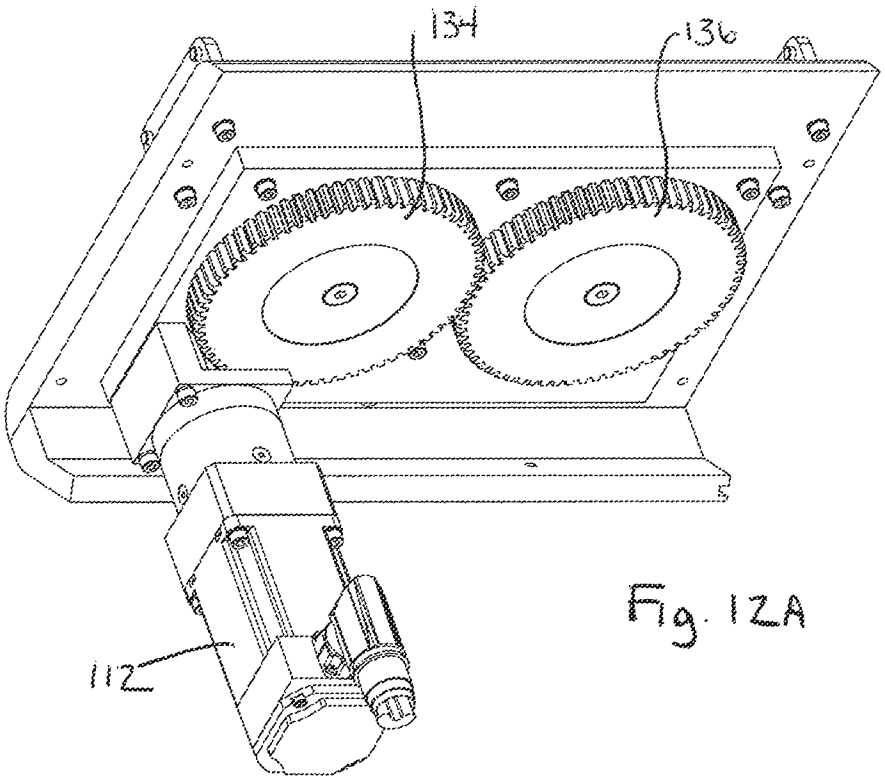
FIGS. 12A, 12B and 13 are bottom views of internal gears of the pusher drive.
Figure 12B:
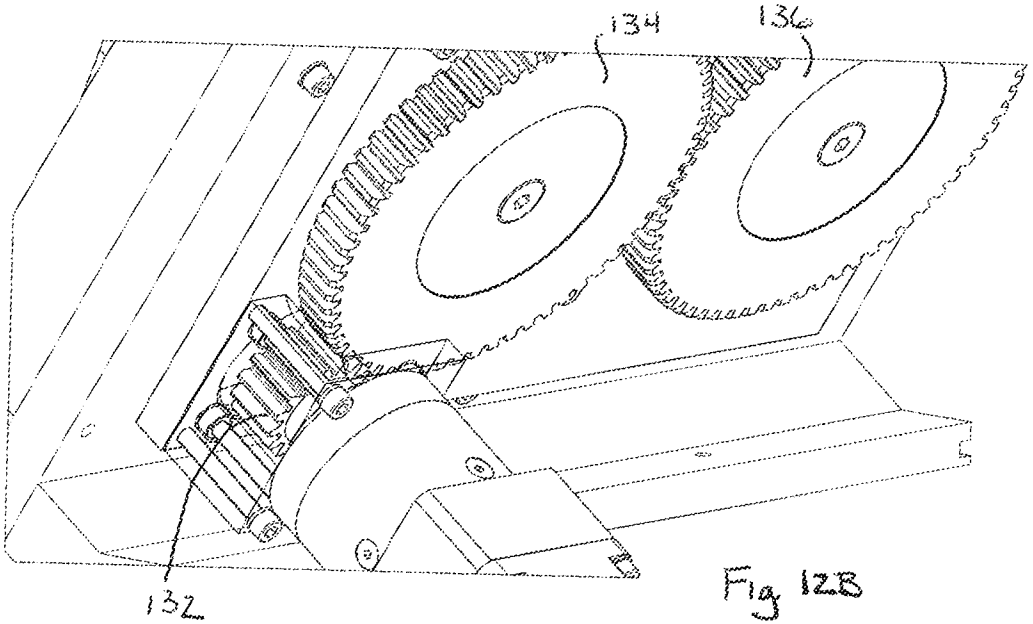
Figure 13:
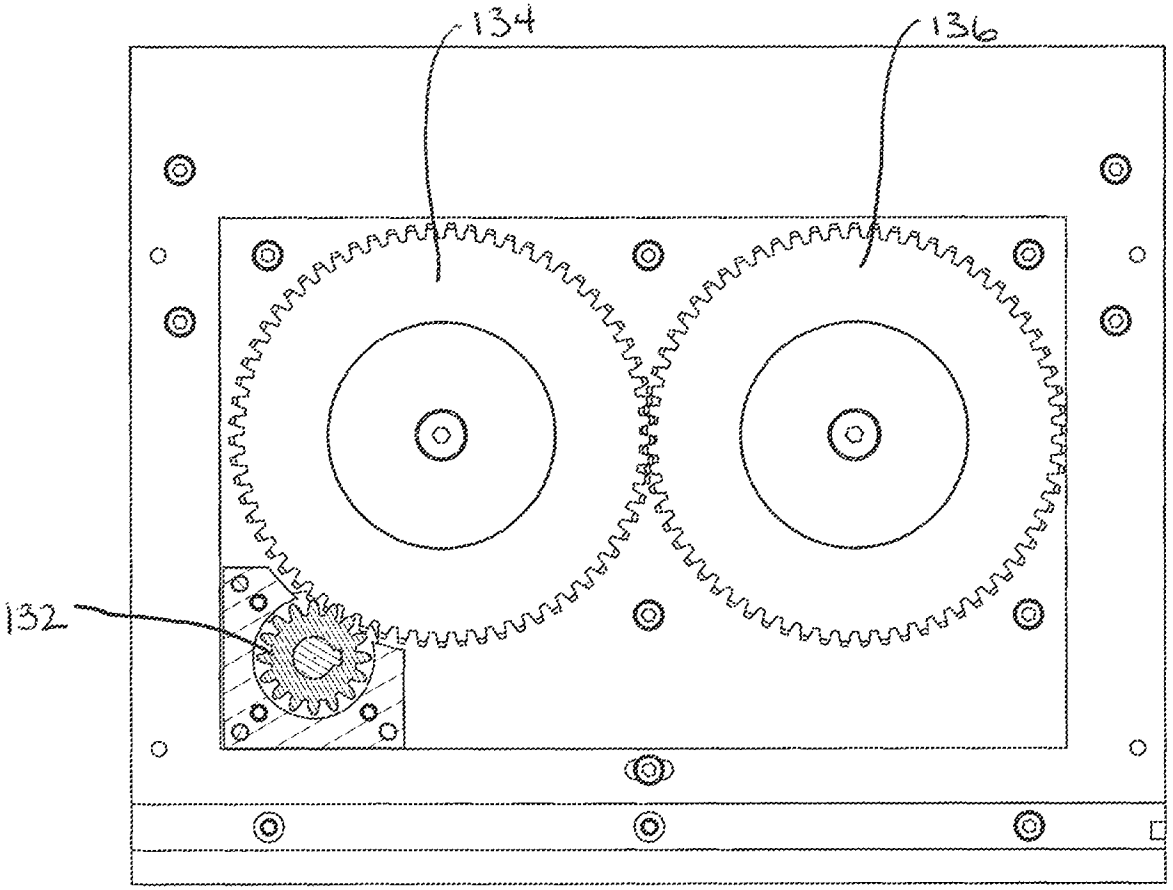

In one example, as best represented by the sequence of FIGS. 9-11, the controller may be configured to rotate the motor 112 so as to rotate the drive gear in a first direction in order to move the pusher from the first position to the second position, and to rotate the drive gear in a second direction in order to move the pusher from the second position to the first position. Per FIG. 9, this results in one disc 110 repeatedly rotating in one direction (clockwise in FIG. 9) to move the pusher from the first position to the second position, and the other disc rotating in an opposite direction (counterclockwise in FIG. 9) for the same movement, and then the two discs reversing direction to move the pusher 94 back the first position, as suggested by arrows 140, 142. By way of example, FIG. 10 shows a ninety degree rotation of the discs 100 and FIG. 11 shows a further ninety degree rotation, which brings the pusher to the second position.

As previously mentioned, the discs 110 are sealingly engaged in the openings 108 of the housing segment 106. The purpose of this arrangement is to maintain the drive system for the pusher within the internal space 114 of the housing so that the drive system will not be exposed to fines or other particulates, such as dust from pharmaceutical tablets. Thus, the exterior of the machine can be readily cleaned, without the need to open up the machine and clean the pusher drive system.

Figure 14:
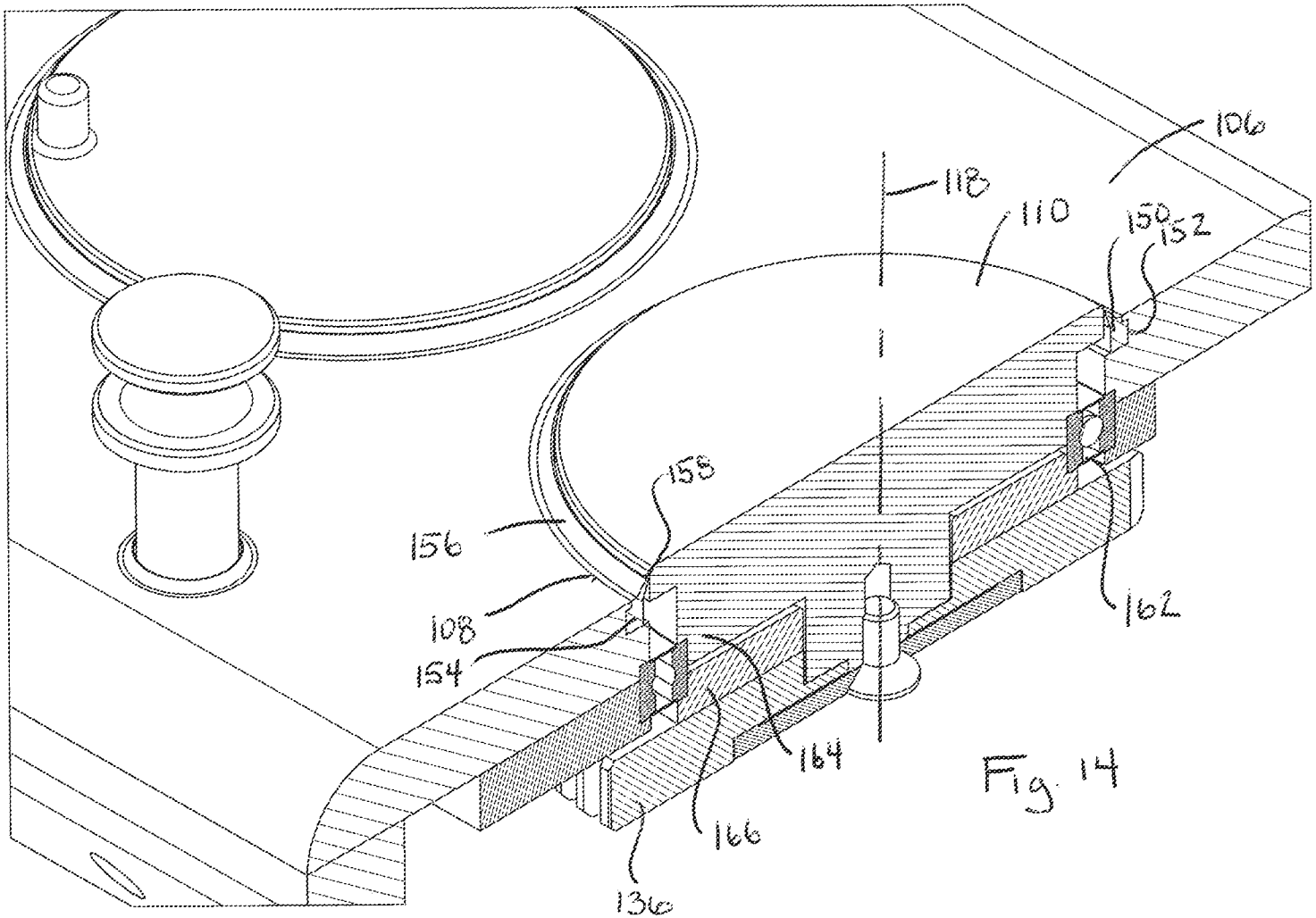
FIG. 14 is a perspective view of a disc mount arrangement.
Figure 15:
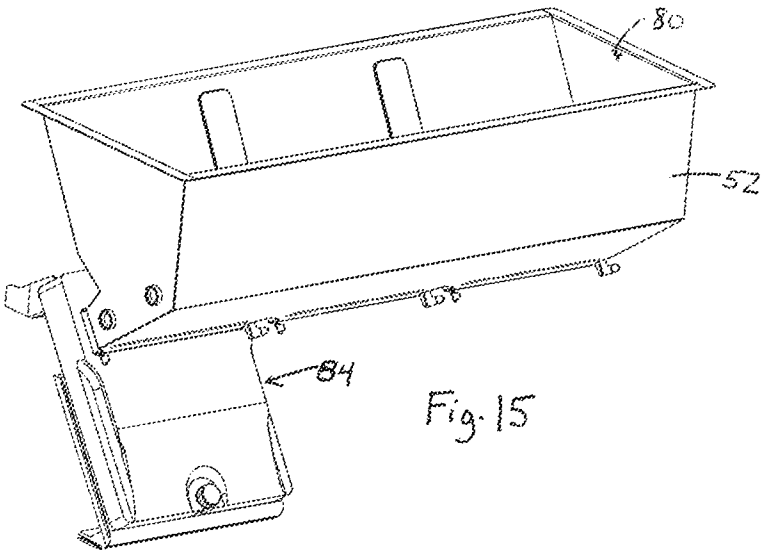
FIG. 15 shows a pusher assembly connected to the hopper

Referring to FIG. 14, a sealing arrangement for the discs, according to one embodiment, is shown. Each opening 108 includes an annular seal 150 fixed therein, and each rotatable disc 110 rotates along its annular seal 150. Each opening 108 includes an annular channel 152 facing the central axis 118 of the opening/rotatable disc, and the annular seal 150 includes a retention portion 154 seated in the annular channel 152 and a flange portion 156 extending outward alongside a peripheral edge 158 of the rotatable disc 110. The flange portion 156 is biased into contact with the peripheral edge to maintain an effective seal.

As also shown, an annular bearing 162 is located inward of the annular seal 150 and the annular bearing 162 is engaged with both a guide hub portion 164 of the rotatable disc and a spaced apart guide plate 166 that is also connected to the hub 164 (e.g., by fasteners). Interconnection of the gear 136 to the disc 110 is also shown, whereby rotating of the gear 136 rotates the disc 110.

As used herein, the term controller is intended to broadly encompass any circuit (e.g., solid state, application specific integrated circuit (ASIC), an electronic circuit, a combinational logic circuit, a field programmable gate array (FPGA)), processor(s) (e.g., shared, dedicated, or group—including hardware or software that executes code), software, firmware and/or other components, or a combination of some or all of the above, that carries out the control functions of the device/machine or the control functions of any component thereof.

It is to be clearly understood that the above description is intended by way of illustration and example only, is not intended to be taken by way of limitation, and that other changes and modifications are possible.

What is claimed is:

1. A filling machine for filling containers with items, the filling machine comprising:

an item conveyor;

a bulk feeder for feeding items onto item conveyor, the bulk feeder comprising:

a hopper for holding a plurality of the items, the hopper having an outlet opening;

a feed assembly positioned adjacent the outlet opening, the feed assembly having an inlet and an outlet, the inlet positioned to receive items from the outlet opening of the hopper, the outlet positioned so that items can be fed on to the infeed end of the item conveyor, wherein the feed assembly includes an item collecting compartment for collecting items that pass through the inlet from the hopper and a pusher movable from a first position to a second position, in the first position the pusher is retracted from the collecting compartment, wherein, as the pusher moves from the first position to the second position, a push end of the pusher moves through the collecting compartment, including below and past the inlet, to push items in the collecting compartment to the outlet and onto the item conveyor;

a rotatable disc mounted on a housing of the filling machine, the rotatable disc coupled to move the pusher linearly back and forth between the first position and the second position as the rotatable disc rotates.

2. The filling machine of claim 1, wherein:

the housing at least in part defines an internal space;

the pusher is movable along an exterior facing surface portion of the housing, the exterior facing surface portion of the housing includes a stationary housing segment having an opening, and the rotatable disc is sealingly mounted in the opening.

3. The filling machine of claim 2, further comprising:

a drive assembly including a rotatable motor positioned within the internal space, the rotatable motor linked to effect rotation of the rotatable disc.

4. The filling machine of claim 3, wherein:

the rotatable disc includes a projecting drive link offset from a central axis of the rotatable disc;

the pusher includes a drive slot facing the rotatable disc and into which the drive link projects, such that an orbital movement of the drive link about the central axis causes the drive link to engage a side of the drive slot to effect linear movement of the pusher.

5. The filling machine of claim 4, wherein:

the opening of the stationary housing segment is a first opening, the rotatable disc is a first rotatable disc, the stationary housing segment includes a second opening, and a second rotatable disc is sealing mounted in the second opening;

the second rotatable disc includes a second projecting drive link offset from a central axis of the second rotatable disc;

the pusher includes a second drive slot facing the second rotatable disc and into which the second drive link projects, such that an orbital movement of the second drive link about the central axis of the second rotatable disc causes the second drive link to engage a side of the second drive slot to effect linear movement of the pusher.

6. The filling machine of claim 5, wherein the rotatable motor is linked to effect rotation of the first rotatable disc in a first direction and to effect rotation of the second rotatable disc in a second direction that is opposite the first direction.

7. The filling machine of claim 6, wherein the motor includes an output shaft coupled to rotate a drive gear, the drive gear is geared to drive a first driven gear that is coupled to rotate the first rotatable disc, the first driven gear is geared to drive a second driven gear that is coupled to rotate the second rotatable disc.

8. The filling machine of claim 7, further comprising:

a controller operatively connected to control the motor, the controller configured to rotate the motor so as to rotate the drive gear such that the pusher is repeatedly moved back and forth between the first position and the second position.

9. The filling machine of claim 8, wherein the controller is configured to rotate the motor so as to rotate the drive gear such that the pusher is moved at a constant speed when moving from the first position to the second position.

10. The filling machine of claim 8, wherein the controller is configured to rotate the motor so as to rotate the drive gear such that the pusher is moved from the first position to the second position in a first travel time, and the pusher is moved from the second position to the first position in a second travel time, wherein the second travel time is shorter than the first travel time.

11. The filling machine of claim 8, wherein the controller is configured to rotate the motor so as to rotate the drive gear in a first direction in order to move the pusher from the first position to the second position, and to rotate the drive gear in a second direction in order to move the pusher from the second position to the first position.

12. The filling machine of claim 2, wherein the opening includes an annular seal fixed therein, and the rotatable disc rotates along the annular seal.

13. The filling machine of claim 12, wherein the opening includes an annular channel facing the central axis of the rotatable disc, the annular seal includes a retention portion seated in the annular channel and a flange portion extending outward alongside an edge of the rotatable disc.

14. The filling machine of claim 12, wherein an annular bearing is located inward of the annular seal, the annular bearing engaged with a guide portion of the rotatable disc.

15. The filling machine of claim 1, wherein the feed assembly is one of multiple feed assemblies positioned adjacent respective outlet openings of the hopper.

16. A filling machine for filling containers with items, the filling machine comprising:

an item conveyor;

a bulk feeder for feeding items onto item conveyor, the bulk feeder comprising:

a hopper for holding a plurality of the items, the hopper having an outlet opening; a feed assembly positioned adjacent the outlet opening, the feed assembly having an inlet and an outlet, the inlet positioned to receive items from the outlet opening of the hopper, the outlet positioned so that items can be fed on to the infeed end of the item conveyor, wherein the feed assembly includes an item collecting compartment for collecting items that pass through the inlet from the hopper and a pusher movable from a first position to a second position, in the first position the pusher is retracted from the collecting compartment, wherein, as the pusher moves from the first position to the second position, a push end of the pusher moves through the collecting compartment to push items in the collecting compartment to the outlet and onto the item conveyor;

wherein the item conveyor has a discharge end that is located such that items traveling along the item conveyor are delivered to multiple paths for delivery toward containers.

17. A filling machine for filling containers with items, the filling machine comprising:

an item conveyor;

a bulk feeder for feeding items onto item conveyor, the bulk feeder comprising:

a hopper for holding a plurality of the items, the hopper having an outlet opening; a feed assembly positioned adjacent the outlet opening, the feed assembly having an inlet and an outlet, the inlet positioned to receive items from the outlet opening of the hopper, the outlet positioned so that items can be fed on to the infeed end of the item conveyor, wherein the feed assembly includes an item collecting compartment for collecting items that pass through the inlet from the hopper and a pusher movable from a first position to a second position, in the first position the pusher is retracted from the collecting compartment, wherein, as the pusher moves from the first position to the second position, a push end of the pusher moves through the collecting compartment to push items in the collecting compartment to the outlet and onto the item conveyor;

wherein a movement path of the pusher from the first position to the second position is upwardly angled.

18. A filling machine for filling containers with items, the filling machine comprising:

a housing at least in part defining an internal space, the housing having an opening with a rotatable disc sealingly mounted therein;

an item conveyor external of the internal space;

a pusher external of the internal space and movable from a first position to a second position so as to push items onto the item conveyor;

a drive located within the internal space, the drive operatively connected for rotating the rotatable disc; and wherein the rotatable disc is coupled to move the pusher linearly as the rotatable disc rotates.

19. The filling machine of claim 18, wherein the pusher is movable along an exterior facing surface portion of the housing, the exterior facing surface portion of the housing includes a stationary housing segment in which the opening is located.

20. The filling machine of claim 18, wherein the rotatable disc includes a projecting drive link offset from a central axis of the rotatable disc, and the pusher includes a drive slot facing the rotatable disc and into which the drive link projects, such that an orbital movement of the drive link about the central axis causes the drive link to interact with the drive slot to effect linear movement of the pusher.

21. The filling machine of claim 18, wherein the drive includes a motor within the internal space.

22. The filling machine of claim 21, further comprising:

a controller operatively connected to control the motor, the controller configured to rotate the motor such that the pusher is repeatedly moved back and forth between the first position and the second position;

wherein the controller is configured to rotate the motor such that the pusher is moved from the first position to the second position in a first travel time, and the pusher is moved from the second position to the first position in a second travel time, wherein the second travel time is shorter than the first travel time.

* * * * *